US008961885B2

(12) United States Patent
Lesky et al.

(10) Patent No.: US 8,961,885 B2
(45) Date of Patent: Feb. 24, 2015

(54) DEVICE FOR THE PURIFICATION OF POLLUTED WASTE GAS

(75) Inventors: Hans-Jürgen Lesky, Voitsberg (AT); Johannes Schedler, Wildon (AT); Heimo Thalhammer, Graz (AT)

(73) Assignee: CTP Chemisch Thermische Prozesstechnik GmbH, Graz (AT)

( * ) Notice: Subject to any disclaimer, the term of this patent is extended or adjusted under 35 U.S.C. 154(b) by 585 days.

(21) Appl. No.: 13/272,861

(22) Filed: Oct. 13, 2011

(65) Prior Publication Data

US 2012/0275964 A1 Nov. 1, 2012

(30) Foreign Application Priority Data

Oct. 14, 2010 (DE) ..... 10 2010 048 308

(51) Int. Cl.
*B01D 53/74* (2006.01)
*F23G 7/06* (2006.01)

(52) U.S. Cl.
CPC ..... *F23G 7/068* (2013.01)
USPC ..... 422/175

(58) Field of Classification Search
CPC ..... F23G 7/068; F23G 7/066; F23G 7/06
USPC ..... 422/175, 173; 432/180, 181; 137/309; 165/9.3
See application file for complete search history.

(56) References Cited

U.S. PATENT DOCUMENTS 5,941,073 A * 8/1999 Schedler et al. ..... 60/687
6,274,097 B1 * 8/2001 Sefalidis et al. ..... 422/175

FOREIGN PATENT DOCUMENTS

DE 19747905 C1 1/1999
DE 20118418 U1 3/2002
EP 0 472 605 A1 3/1992

* cited by examiner

*Primary Examiner* — Jill Warden
*Assistant Examiner* — Joye L Woodard
(74) *Attorney, Agent, or Firm* — Ohlandt, Greeley, Ruggiero & Perle, LLP

(57) ABSTRACT

A device for the purification of polluted waste gas by means of regenerative thermal oxidation. The device has at least two heat-accumulator towers having a common combustion chamber and each containing a heat-accumulator material, the upper ends of which face the combustion chamber. The heat-accumulator towers are each connected via a control chamber to a channel for the supply of the raw gas to be purified and a channel for the discharge of clean gas. The two channels are each connectable to the at least two heat-accumulator towers via the control chambers for an alternating supply of raw gas and discharge of clean gas via shut-off devices actuable by actuators. The two channels are arranged laterally adjacent to the heat-accumulator towers and are located adjacent each other and above the respective control chambers and interconnected with the respective control chambers through openings therebetween, with the openings being closable via shut-off devices.

18 Claims, 5 Drawing Sheets

DEVICE FOR THE PURIFICATION OF POLLUTED WASTE GAS

BACKGROUND OF THE DISCLOSURE

1. Field of the Disclosure

The invention relates to a device for the purification of polluted waste gas by means of regenerative thermal post-combustion according to the preamble of claim 1.

2. Description of the Related Art

Such facilities, which serve, in particular, for the purification of air containing organic compounds such as solvents, are known, for example, from EP 0 472 605 B1, whereby each tower forms a chamber, with the organic compounds in the exhaust air being combusted in the combustion chamber connecting the upper ends of the two chambers with each other. In the event that the exhaust air is supplied to the chamber in the first tower, it is preheated by its heat-accumulator material, the organic compound is combusted in the preheated exhaust air in the combustion chamber, and the heat-accumulator material is heated in the chamber of the second tower by the hot, purified exhaust air. Then a change of the exhaust air supply to the chamber in the second tower takes place, while the purified exhaust air is drawn from the chamber of the first tower.

In case of the known device, in practice two tubes with a diameter corresponding to the high performance of such a purification device extend in the longitudinal direction below the towers arranged side by side for the supply of the exhaust air or raw gas to be purified and/or the discharge of the purified exhaust air or clean gas, with said tubes being attached to a pre-combustion chamber below each tower by means of connecting pieces. The openings of the two connecting pieces in the pre-combustion chamber are provided with shut-off devices, each being actuable by means of an actuator, which are formed by piston-cylinder units arranged below the large tubes.

A further embodiment is described in DE 20118418 U1. In this embodiment, the control members are arranged horizontally in the form of poppet valves in order to transfer the exhaust air to the heat exchange areas in a manner which is as favorable as possible to flow.

In this case, too, the design is very complex; much additional height below the regenerators is required.

Furthermore, it is known from DE 19747905 C1 to align the towers opposite to each other. The inlet and outlet waste gas paths are produced by means of an intermediate valve box. In this case, the dead volume has already been optimized in order to minimize switching losses. However, the access to the change-over valves between the towers is very difficult, and six regenerative half towers having intermediate high-temperature resistant separations are necessary for this type.

Since the facility is not separable, the transport effort is very high in case of larger types; maximum heights and widths are rapidly achieved.

SUMMARY OF THE INVENTION

It is therefore the technical problem of the invention to obtain an economic design with high purification efficiency of the regenerative thermal oxidation device by reducing the transport dimensions, weight and space required.

According to the invention, the technical problem is solved by the device characterized in claim 1. Advantageous embodiments of the invention are described in the dependent claims.

The technical problem is solved by means of a device for the purification of polluted waste gas by regenerative thermal oxidation comprising at least two heat-accumulator towers with a common combustion chamber. At least one heat-accumulator material being connected with its upper end to the combustion chamber is arranged in each of the heat-accumulator towers. The heat-accumulator towers are each connected via a control chamber to a channel for the supply of the raw gas to be purified and a channel for the discharge of the clean gas. By means of shut-off devices being actuable by actuators, the channels are each connectable to the at least two heat-accumulator towers via the control chambers for the alternating supply of raw gas and discharge of clean gas. The channels for the supply of raw gas and the discharge of clean gas are arranged laterally adjacent to the heat-accumulator towers and provided on the side of the openings opposite to the control chambers, with said openings being closable by means of the actuator.

A preferred embodiment of the device is characterized in that the two channels for the supply of raw gas and the discharge of clean gas with the subjacent control chambers are arranged side by side, separated by a partition wall, e.g. a folded plate.

A further preferred embodiment of the device is characterized in that that the exhaust air and/or the air supplied to the heat-accumulator towers are controlled by means of vertically disposed poppet valves.

Preferably, the poppet valves comprise an inner rod, which moves the valve disc by a linear drive, and an outer tube, which is connected to a seal carrier by a star-shaped reinforcement member.

Preferably, the inner rod of the poppet valve is guided in the outer tube.

Preferably, the linear drive for actuating the poppet valve is driven pneumatically or hydraulically.

A further preferred embodiment of the device is characterized in that at least one combustion device is arranged in the area of the bottom of a clearance between two heat-accumulator towers in the direction of the combustion chamber.

Preferably, the combustion device is disposed obliquely upward towards the center of the combustion chamber.

A preferred embodiment of the device is characterized in that the heat-accumulator towers are each connected to a duct for purging the heat-accumulator material.

Preferably, the purge ducts are connected to a shut-off valve linked by an actuator for each heat-exchanger tower.

Preferably, the ducts for purging the heat-accumulator materials are arranged laterally of the heat-accumulator towers.

In a preferred embodiment of the device, the ducts for purging the heat-accumulator materials are at least partially arranged inside the channels for the supply of raw gas and/or the discharge of clean gas.

The width of the device is minimized by the towers arranged in series. In the device according to the invention, the channels for the supply of raw gas and the discharge of clean gas as well as the control chambers are combined to form a compact, laterally attached control unit, which is also referred to below as "valve box". Thus, the device can easily be separated into two parts for transport purposes.

In addition, the construction volume and the weight of the device according to the invention are reduced, because the channels for the supply of raw gas and the discharge of clean gas are preferably arranged side by side above the control area.

The connection to the regenerative heat-exchanger towers is established in the control area.

The control unit forms a self-contained assembly group. At the place of destination, it is connected to the assembly group of the regenerative heat-exchanger towers with the combustion chamber mounted thereon. Due to the lateral arrangement of the control unit, the overall height of the two main components is low, which is why transport costs are kept low and a complex platform or stair construction serving as an access to the combustion chamber and/or the control valves may be omitted.

In addition, the device according to the invention is extremely easy to maintain. Thus, work on the actuators and shut-off devices are easy and can safely be carried out from the ground; the same applies to the purification of the lower area of the heat-accumulator materials.

The burner or burners may likewise be replaced by other heating devices, for example electric heating rods.

By means of the device according to the invention comprising altogether three heat-accumulator towers, a purification efficiency of >95%, preferably >98%, and particularly preferably >99.5%, is obtained.

Upon failure of an actuator and/or shut-off device, the device can be operated as a two-tower system instead of a three-tower system, with the two-tower system still obtaining a purification efficiency of approx. 98%. The necessary maintenance work on the actuator and/or shut-off device failed can be carried out during the operation of the two-tower system.

In the control unit, the clean gas area is preferably separated from the raw gas area by a vertical folded partition wall, with the raw gas area and the clean gas area each having connections in each tower. Each of said connections is closable by means of a poppet valve.

In the device according to the invention, the heat-accumulator material may be formed as a honeycomb catalyst at least in the upper area. In this case, regenerative thermal oxidation is concerned.

BRIEF DESCRIPTION OF THE DRAWINGS

Based on the drawings, an embodiment of the device according to the invention is described in more detail below by way of example.

FIG. 1 shows an embodiment of the device 1 as viewed in cross-section. The device 1 comprises at least two heat-accumulator towers 2, only one of which, i.e. the front one, is shown in the drawing of FIG. 1. The at least second heat-accumulator tower is arranged behind the first heat-accumulator tower 2. Each of the heat-accumulator towers 2 has a lower subarea, in which at least one heat-accumulator material 4 is disposed.

Figure 1:
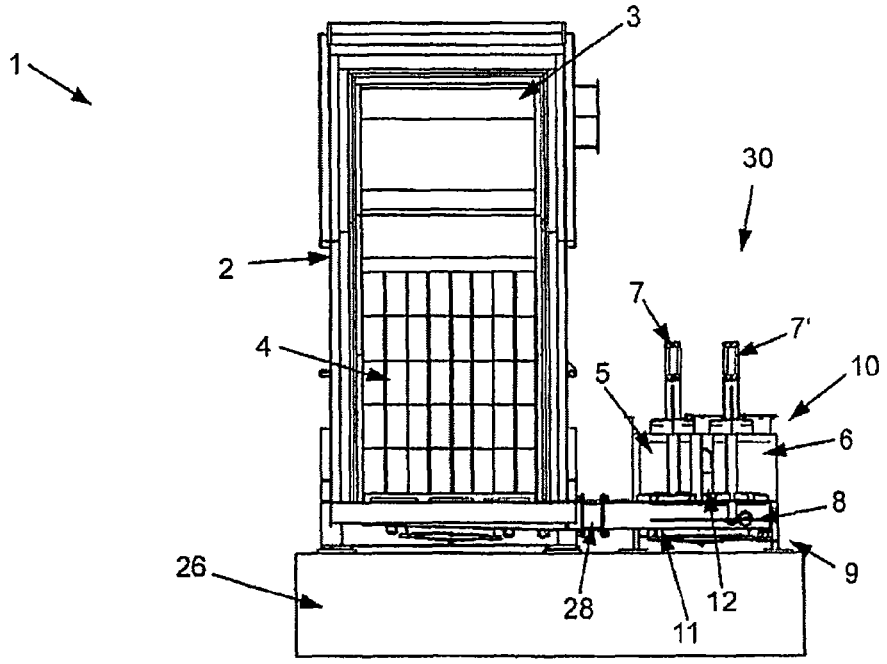
FIG. 1 shows a cross-sectional view of an embodiment of the device.

The heat-accumulator material 4 is preferably formed by honeycombed molds having prismatic channels, through which the gas flows vertically, with the honeycombed structure providing for an as large a contact surface as possible. The combustion chamber 3 of the heat-accumulator towers 2 is arranged above the heat-accumulator material 4. The heat-accumulator towers 2 of the device 1 form a connected combustion chamber 3.

Together with a valve box 30, the heat-accumulator tower 2 is arranged on a base 26.

The valve box 30 comprises a first channel 5 and a second channel 6, through which raw gas is supplied to and/or clean gas is discharged from the heat-accumulator towers 2. In the illustrated embodiment of the device 1, the two channels 5 and 6 are separated from each other by means of a vertically disposed partition plate 12. The channels may also be spaced from each other and each surrounded by a separate channel housing. In order to take up little space, however, the option comprising a partition plate 12 as shown in the illustrated embodiments is best suited.

The raw gas is conveyed via the first channels 5 or 6 to the heat-accumulator towers 2. The valve box 30 comprises two actuators 7, 7' for each heat-accumulator tower. In case of each heat-accumulator tower 2, the first channel 5 is provided with an actuator 7 and the second channel 6 with an actuator 7'. The channels 5, 6 can be connected to the respective heat-accumulator tower 2 by means of the actuators 7, 7'. In this case, either the actuator 7 of the channel 5 with raw gas or the actuator 7' of the channel 6 with clean gas is in an open position towards the respective heat-accumulator tower 2. The channels 5 and/or 6 are disposed in the upper area 10 of the valve box 30. In order to reach the heat-accumulator towers 2, the raw gas and/or clean gas flow through one of the opened actuators 7, 7' into a control chamber 11 arranged below the channels 5 and/or 6.

Via the control chamber 11, the raw gas and/or clean gas passes through a connection channel 28 to reach the respective heat-accumulator tower 2. The raw gas flows, for example, from the channel 5 in the valve box 30 through the opened actuator 7 into the control chamber 11. From the control chamber 11, the raw gas flows via the connection channel 28 through the heat-accumulator material 4 from below into the heat-accumulator tower 2, the heat-accumulator material 4 of which has been heated before. After the raw gas has been heated by the heat-accumulator material 4 of the first heat-accumulator tower 2, the organic pollutants contained in the raw gas are combusted in the combustion chamber 3, with the highly heated clean gas reaching the area of the heat-accumulator material 4' of the next heat-accumulator tower 2'. After the heat-accumulator material 4' of the heat-accumulator tower 2' has been heated, the cooled clean gas flows back through the connection channel 28' to the respective control chamber 11' and through the opened actuator 7' into the second channel 6. Via the channel 6, the clean gas is then discharged from the valve box 30. In an analogous manner, the waste gas is conveyed from tower 2' to tower 2" in the next cycle, and from tower 2" to tower 2 in the third cycle.

Figure 2:
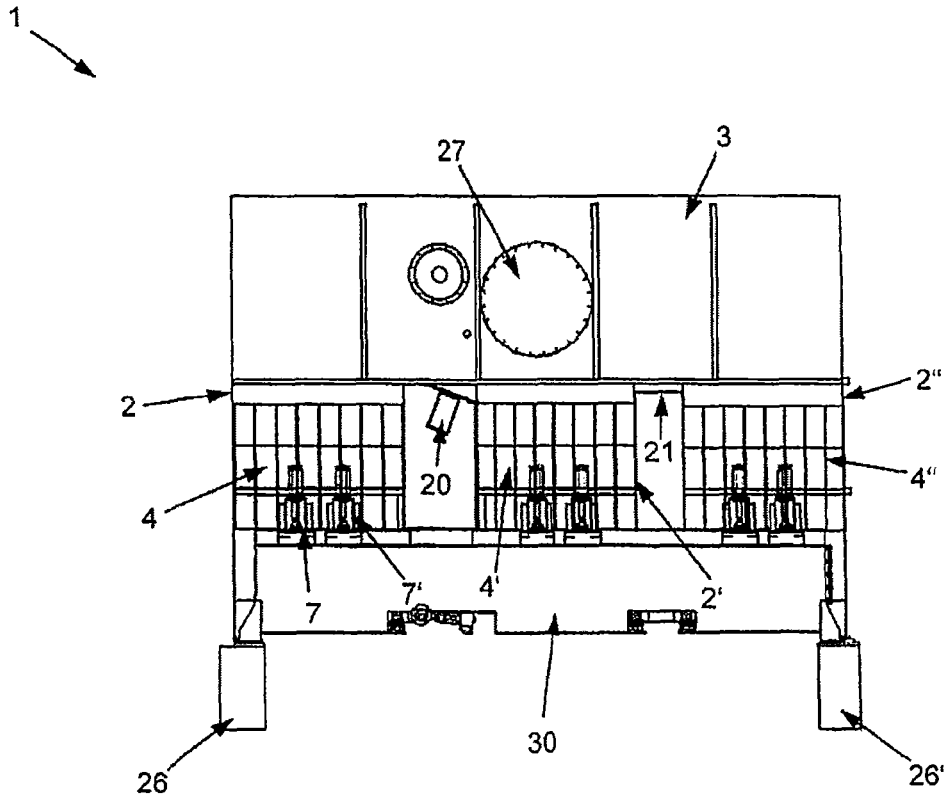
FIG. 2 shows a front view of the device according to FIG. 1 with the wall of the heat-accumulator towers being partially removed.

The arrangement of the heat-accumulator towers 2, 2', 2" for an embodiment of the device 1 having three heat-accumulator towers is shown in detail in FIG. 2. FIG. 2 reveals the actuators 7, 7' for the respective heat-accumulator towers 2, 2', 2". The actuators 7, 7' protrude from the valve box 30 on its top side. A clearance 21 is each provided between two heat-accumulator towers 2, 2' and/or 2', 2", thereby reducing the thermal load of the walls of the towers 2, 2'.

In the upper area above the respective heat-accumulator materials 4, 4', 4", the heat-accumulator towers 2, 2', 2" form a connected combustion chamber 3. In the illustrated embodiment of the device 1, a combustion device 20 is arranged between the left heat-accumulator tower 2 and the central heat-accumulator tower 2'. In order to inter alia maintain the combustion device 20, the central heat-accumulator tower 2' has a maintenance opening 27 in the upper area. In the embodiment of the device 1 according to FIG. 2, the heat-accumulator materials 4, 4', 4" are shown as illustrated in FIG. 1.

Figure 3:
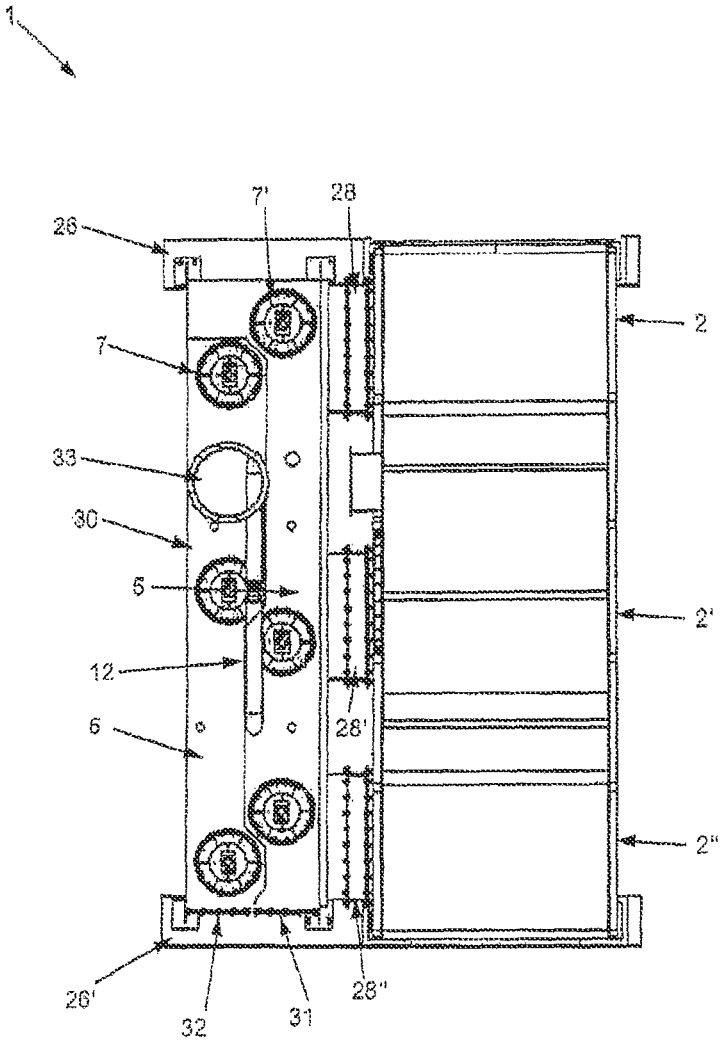
FIG. 3 shows a top view of the device according to FIGS. 1 and/or 2.

FIG. 3 is a further view of the embodiment of the device 1 shown in FIGS. 1 and/or 2. FIG. 3 is a top view of the embodiment of the device 1 shown in FIGS. 1 and 2. The area of the valve box 30 is partially illustrated in a transparent manner so that the course of the channels 5 and/or 6 inside the valve box 30 is visible. In the illustrated embodiment of the device 1, the channels 5 and 6 for the raw gas and/or clean gas are separated from each other by means of a partition plate 12. The partition plate 12 extends between the two actuators 7, 7', which lead to the respective heat-accumulator towers 2, 2', 2".

In order to minimize the space required for the valve box 30, the actuators 7, 7' are each arranged offset relative to each other. The partition plate 12 between the actuators 7, 7' extends obliquely between the actuators 7, 7' in this area. In the illustrated embodiment, the valve box 30 of the device 1 is provided with two alternative outlet openings 32 and 33 for the clean gas from the channel 6. The raw gas enters the channel 5 of the valve box 30 via the inlet opening 31.

Figure 4A:
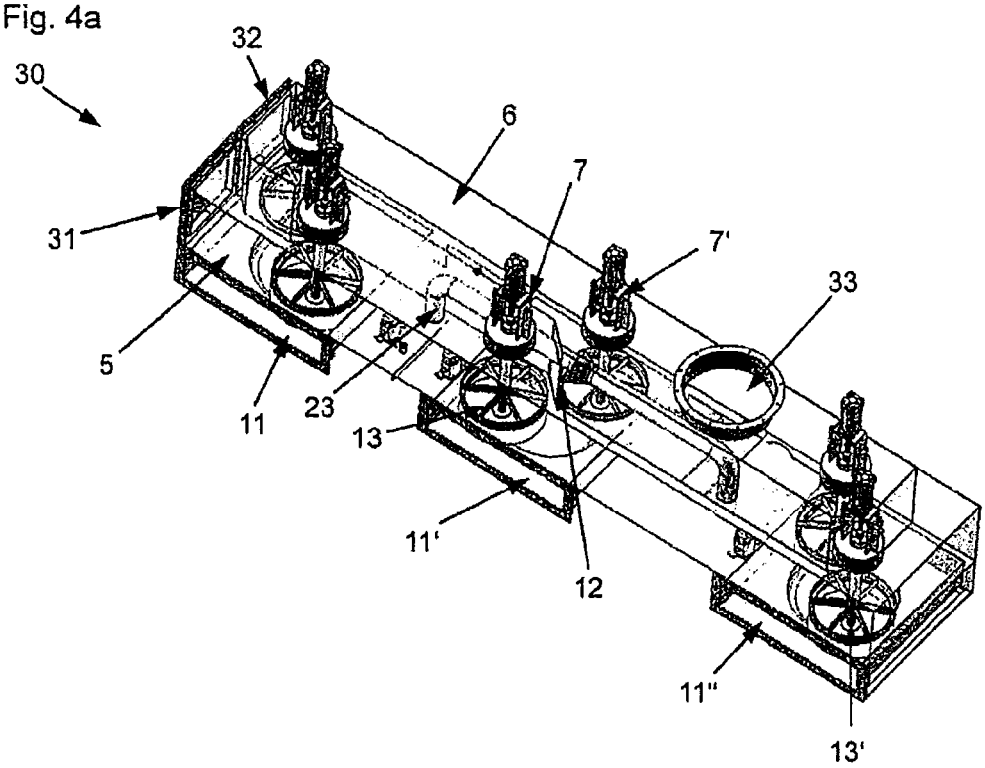
FIGS. 4*a* and 4*b* show various three-dimensional perspective views of an embodiment of the valve box of the device.
Figure 4B:
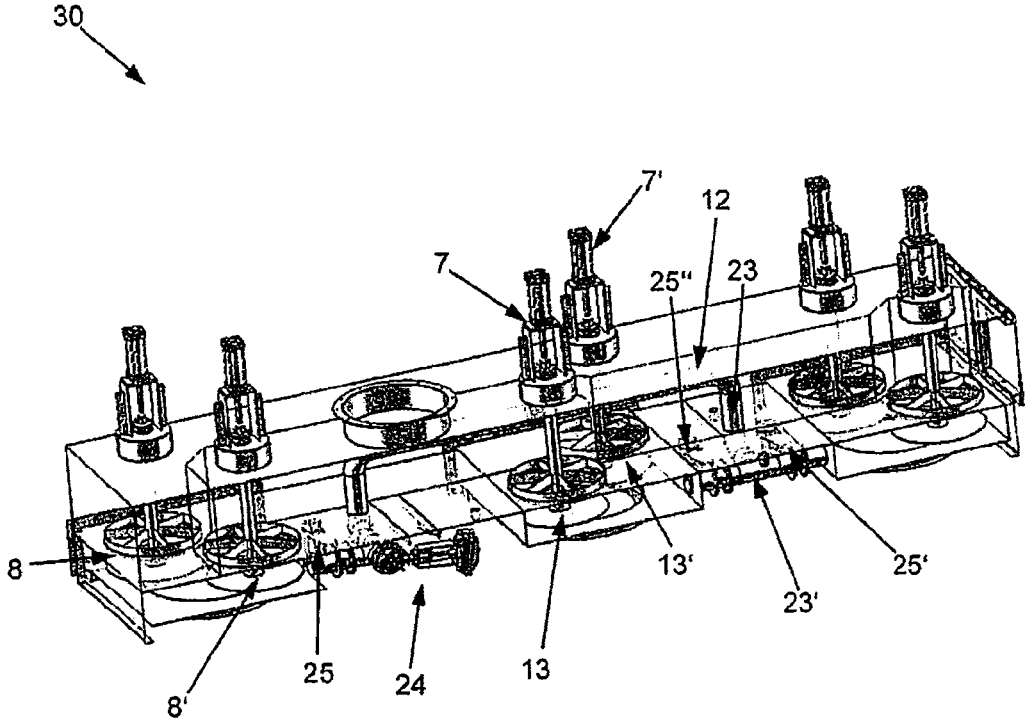

FIGS. 4*a* and 4*b* show various three-dimensional views of an embodiment of the valve box 30 of the device 1. FIGS. 4*a* and 4*b* very clearly show the course of the partition plate 12. The partition plate 12 extends between the first channel 5 and the second channel 6 and divides the internal space of the valve box into the two channels 5 and 6. Between the actuators 7, 7', the partition plate 12 extends in the center between the two actuators 7, 7' in as space-saving a manner as possible.

The device 1 is provided with a purging device in order to remove raw gas residues from the heat-accumulator material of the heat-accumulator tower, through which the clean gas is intended to flow after the raw gas has been supplied. The purging device comprises a duct 23 and/or 23' conveying the purge gas via the respective control chambers 11, 11', 11" to the heat-accumulator towers. Clean gas is preferably used as purge gas displacing the raw gas upward into the combustion chamber 3. For controlling the respective ducts, the latter are provided with the control valve 24 and the actuators 25, 25', 25" in the area of the control chambers 11, 11', 11". In the illustrated embodiment of the device 1, the duct 23 is guided between the individual control chambers 11, 11' and 11" through the channels 5 and 6, with the duct 23 preferably passing the partition plate 12.

Figure 5:
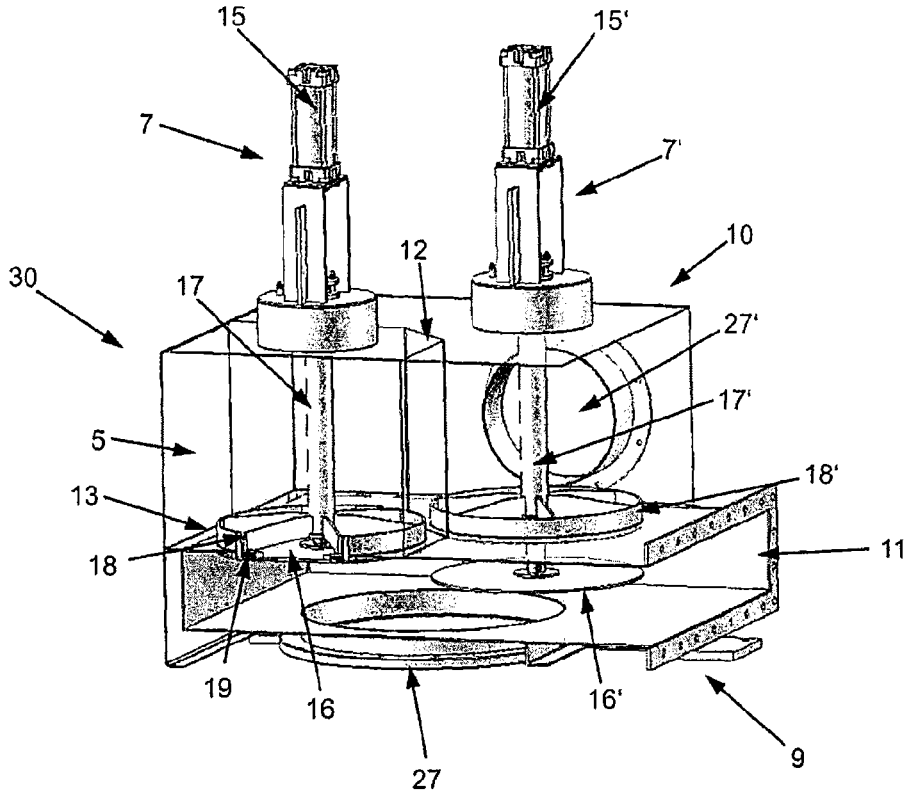
FIG. 5 shows a section of the valve box according to FIGS. 4*a* and/or 4*b* in detail.

FIG. 5 is a detailed view of the embodiment of the valve box 30 shown in FIGS. 4*a* and/or 4*b*. In its upper area 10, the valve box 30 comprises the two channels 5 and 6, via which raw gas is supplied to and/or clean gas is discharged from the heat-accumulator towers. The detail of the valve box 30 shown in FIG. 5 reveals that the valve disc 16 of the first actuator 7 is closed, whereas the second valve disc 16' of the second actuator 7' is opened. In order to open and/or close the disc 16 and/or 16', the actuators 7, 7' each comprise a linear drive 15, 15' being connected to the discs 16, 16' by means of a rod. The rod is guided in a tube 17 and/or 17'. For fixing the rod in the center of the opening of the channel 5 and/or 6 towards the control chamber 11, the tube 17 and/or 17' is provided with a star-shaped reinforcement member 18 and/or 18'. On the bottom side, the star-shaped reinforcement member 18 and/or 18' has a seal carrier 19 being provided with a seal. By means of seal carrier 19, the disc 16 is preferably closed in a gas-tight manner in the event that the disc 16 is in the closed upper position. The valve body of the poppet valve 13 and/or 13' is formed by the disc 16 and/or 16' together with, inter alia, the seal carrier 19 of the star-shaped reinforcement member 18 and/or 18'. Since the shut-off wall, in which the openings being closable by the valve discs 16, 16' are provided, preferably consists of sheet metal, a tight contact of the valve discs 16, 16' in the closing position is achieved by means of the star-shaped reinforcement members 18, 18'.

In order to maintain the poppet valves 13 and/or 13', the valve box 30 has a maintenance opening 27' in the area of the channel 6. In the illustrated embodiment, a further maintenance opening 27 is disposed on the bottom side of the control chamber 11. For maintenance work on the second poppet valve 13 in the area of the front channel 5, a further maintenance opening may be provided, which is, however, not shown in FIG. 5. The configuration of the actuator 7 together with the rod arrangement and the poppet valve 13 is shown in detail in FIGS. 6 and 7.

Figure 6:
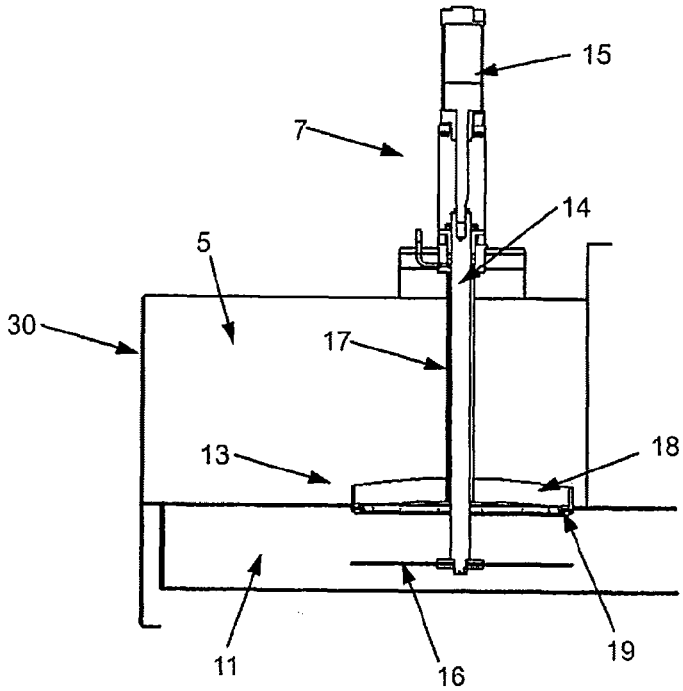
FIG. 6 shows a detailed view of the valve box with a poppet valve.

FIG. 6 is a detailed view of the valve box 30 including the actuator 7 with the poppet valve 13. The actuator 7 comprises a linear drive 15 being connected to a poppet valve 13 by means of a rod 14. The rod 14 of the actuator 7 is guided inside the valve box 30 and partially above the valve box in the tube 17. In the opening area between the channel 5 and the control chamber 11 arranged below, the tube 17 is centrally fixed by means of the star-shaped reinforcement member 18. On the bottom side of the star-shaped reinforcement member 18, the seal carrier 19 having a seal is disposed sealing the disc 16 in the closed state. Upon opening of the poppet valve 13, the disc 16 is moved into the control chamber 11 arranged below the channel 5 so that the gas is capable of flowing from the channel 5 into the control chamber 11 arranged below and/or from the control chamber 11 into the channel 5. As illustrated in FIGS. 1 through 4, the control chamber 11 is connected to the heat-accumulator towers of the device 1.

Figure 7:
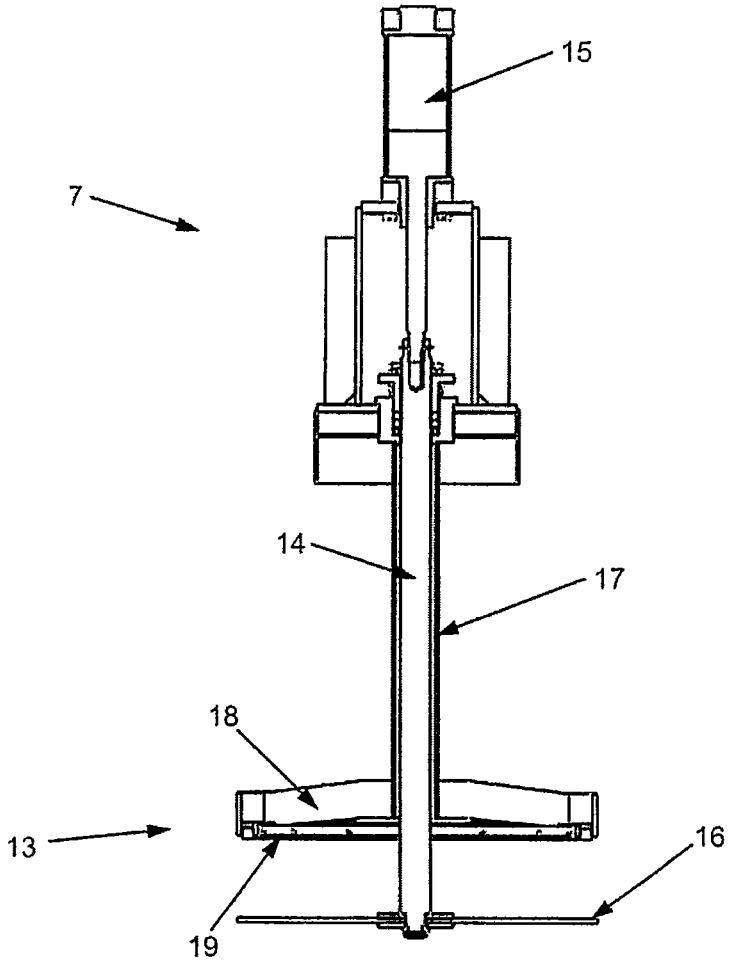
FIG. 7 shows a further detailed view of the poppet valve according to FIG. 6.

FIG. 7 is a further detailed view of the poppet valve 13 and the actuator 7 shown in FIG. 6. The actuator 7 comprises the linear drive 15, for example in the form of a pneumatic or hydraulic drive, driving the rod 14, which is connected to the poppet valve 13. The rod 14 opens and/or closes the poppet valve 13 by an upward and/or downward movement of the disc 16 of the poppet valve 13. The rod 14 is guided in the tube 17. The tube 17 is held centrally in the valve opening by means of the star-shaped reinforcement member. In order to seal the edge of the disc 16 in the closed state, the seal carrier 19 with an inserted seal is arranged on the bottom side of the star-shaped reinforcement member 18. The seal carrier 19 seals the disk 16 of the poppet valve 13 preferably in a gas-tight manner.

Even though in the illustrated embodiments of the device only an embodiment having three heat-accumulator towers is shown, the invention is not restricted to this embodiment. In fact, it is possible that the device has only two or even four, five or more heat-accumulator towers. In this case, the device is constructed according to the illustrated embodiments.

LIST OF REFERENCE NUMERALS

1 device
2, 2', 2" heat-accumulator tower
3 combustion chamber
4, 4', 4" heat-accumulator material
5 channel
6 channel
7, 7' actuator
9 bottom side
10 top side
11, 11', 11" control chamber
12 partition plate

13, 13' shut-off device (poppet valve)
14, 14' rod
15, 15' linear drive
16, 16' valve disc
17, 17' outer tube
18, 18' star-shaped reinforcement member
19 seal carrier
20 combustion device
21 clearance
22 center of combustion chamber
23, 23' duct
24, control valve
25, 25', 25" shut-off valve
26, 26' base
27, 27' maintenance opening
28, 28' connection channel
30 valve box
31 inlet opening
32 outlet opening
33 outlet opening

The invention claimed is:

1. A device for the purification of polluted waste gas by means of regenerative thermal oxidation, having at least two heat-accumulator towers comprising a common combustion chamber and each containing a heat-accumulator material, with the upper ends of which facing the combustion chamber, wherein the heat-accumulator towers are each connected via a control chamber to a channel for the supply of the raw gas to be purified and a channel for the discharge of the clean gas, and the two channels are each connectable to the at least two heat-accumulator towers via the control chambers for the alternating supply of raw gas and discharge of clean gas by means of shut-off devices being actuable by actuators, wherein the two channels for the supply of raw gas and the discharge of clean gas are arranged laterally adjacent to the heat-accumulator towers and are located adjacent each other and above the respective control chambers and interconnected with the respective control chambers through openings therebetween, with said openings being closable by means of the shut-off devices.

2. Device according to claim 1, wherein the two channels are separated from each other by means of a vertical partition wall.

3. Device according to claim 2, wherein the openings towards the respective control chambers being closable by the shut-off devices are separated from each other by means of the vertical partition wall.

4. Device according to claim 2, wherein the openings towards the respective control chambers being closable by means of the shut-off devices are arranged side by side, but offset relative to each other in the longitudinal direction of the raw gas and clean gas channel, and the partition wall between the two openings is angled.

5. Device according to claim 2, wherein a control unit is provided, comprising opposite side walls, a top side and a bottom side, wherein the bottom side is formed by a shut-off wall separating the control chambers from the two channels, wherein the space between the two side walls, the top side and the bottom side of the control unit is divided into the two channels by the partition wall.

6. Device according to claim 5, wherein the actuators are arranged on the top side of the control unit.

7. Device according to claim 2, wherein the partition wall between the two channels and/or a shut-off wall, in which the openings being closable by means of the shut-off devices are provided, consist of folded sheet metal.

8. Device according to claim 1, wherein each control chamber is connectable to the raw gas channel by means of a first shut-off device, and to the clean gas channel by means of a second shut-off device.

9. Device according to claim 1, wherein the openings towards the control chambers being closable by means of the shut-off devices are provided in a shut-off wall separating the control chambers from the raw gas and clean gas channel.

10. Device according to claim 1 wherein the shut-off devices are in the form of poppet valves with vertically movable valve discs.

11. Device according to claim 10, wherein the poppet valves comprise a rod attached to the valve disc and being movable by a linear drive and guided in an outer tube, which is connected to a star-shaped reinforcement member provided with a seal carrier.

12. Device according to claim 11, wherein the linear drive is driven pneumatically or hydraulically.

13. Device according to claim 1, wherein a combustion device is arranged in the area of the bottom of a clearance between two heat-accumulator towers in the direction of the combustion chamber.

14. Device according to claim 13, wherein the combustion device is arranged obliquely upward towards the center of the combustion chamber.

15. Device according to claim 1, wherein the heat-accumulator towers are each connected to a duct for purging the heat-accumulator materials.

16. Device according to claim 15, wherein the purge duct is connected to three control chambers by means of a control valve with three shut-off valves.

17. Device according to claim 16, wherein the purge ducts are arranged laterally of the heat-accumulator towers.

18. Device according to claim 15, wherein the purge ducts are at least partially arranged inside the channels for the supply of raw gas and/or the discharge of clean gas.

* * * * *